US011753209B1

(12) United States Patent
Parry et al.

(10) Patent No.: US 11,753,209 B1
(45) Date of Patent: Sep. 12, 2023

(54) CONTAINER COVERING

(71) Applicants: Thomas Neil Parry, St. Petersburg, FL (US); Madison M. Gillespie, St. Petersburg, FL (US); Lucas Allen Williamson, Cincinnati, OH (US)

(72) Inventors: Thomas Neil Parry, St. Petersburg, FL (US); Madison M. Gillespie, St. Petersburg, FL (US); Lucas Allen Williamson, Cincinnati, OH (US)

( * ) Notice: Subject to any disclaimer, the term of this patent is extended or adjusted under 35 U.S.C. 154(b) by 18 days.

(21) Appl. No.: 17/508,142

(22) Filed: Oct. 22, 2021

(51) Int. Cl.
*B65D 23/08* (2006.01)
*B65D 23/14* (2006.01)
*A45F 5/00* (2006.01)

(52) U.S. Cl.
CPC ..... *B65D 23/0892* (2013.01); *A45F 5/00* (2013.01); *B65D 23/14* (2013.01); *A45F 2200/0583* (2013.01)

(58) Field of Classification Search
CPC ..... B65D 23/0892; B65D 23/14; A45F 5/00; A45F 2200/0583
USPC ..... 215/395
See application file for complete search history.

(56) References Cited

U.S. PATENT DOCUMENTS 1,208,728 A * 12/1916 Bartlett et al. ..... A45F 5/00 224/617
D288,653 S * 3/1987 Crymes ..... D7/606
D315,477 S * 3/1991 Shearer ..... D7/607
D335,957 S * 6/1993 Cantrell ..... D3/229
5,313,807 A * 5/1994 Owen ..... B65D 81/3886 62/530
D370,599 S * 6/1996 Christopher ..... D7/605
D374,975 S * 10/1996 Vargas ..... D3/202
5,842,571 A * 12/1998 Rausch ..... A45C 13/02 206/541
D421,837 S * 3/2000 Pradella ..... D3/234
6,073,796 A * 6/2000 Mogil ..... B65D 81/3886 220/592.24
6,237,776 B1 * 5/2001 Mogil ..... A45F 3/02 150/112
6,385,992 B1 * 5/2002 Flore, Jr. ..... A45F 3/18 62/457.4
6,401,993 B1 * 6/2002 Andrino ..... A45F 5/00 D3/229
6,439,389 B1 * 8/2002 Mogil ..... A45F 3/02 206/217
D474,887 S * 5/2003 Forster ..... D3/229
D476,477 S * 7/2003 DeChant ..... D3/205
D531,858 S * 11/2006 Johnson ..... D7/620
(Continued)

*Primary Examiner* — Ernesto A Grano
(74) *Attorney, Agent, or Firm* — Robert R. Lech; Lech Law, LLC

(57) ABSTRACT

The present application describes a sleeve for retaining a container. The sleeve comprising: a front element, a rear element, and a plurality of side elements. The front element comprises a substantially inelastic material forming a pouch. The front element further comprises a top edge and an exterior surface. The top edge defines a front aperture, and the front element further comprises an elastic collar attached to the top edge. The rear element comprises a substantially inelastic material forming a closeable space. The rear element further comprises a zipper and an exterior surface. The zipper is configured to open and close the closeable space. The plurality of side elements comprise an elastic material.

10 Claims, 9 Drawing Sheets

(56) References Cited

U.S. PATENT DOCUMENTS

| | | | | |
|---|---|---|---|---|
| 7,252,213 | B1 * | 8/2007 | DeSanto | B65D 81/3886 224/148.7 |
| D567,595 | S * | 4/2008 | Christopher | D3/229 |
| 7,510,157 | B2 * | 3/2009 | Oliver | A47G 23/0225 224/400 |
| D630,429 | S * | 1/2011 | Reyes | D3/229 |
| D653,445 | S * | 2/2012 | Enghard | D3/229 |
| D658,871 | S * | 5/2012 | Voit | D3/226 |
| 9,027,806 | B1 * | 5/2015 | Gioggia | A45F 5/02 224/269 |
| 9,265,318 | B1 * | 2/2016 | Williams | A45C 11/20 |
| 9,307,854 | B2 * | 4/2016 | Myers | B65D 25/22 |
| D773,800 | S * | 12/2016 | Willows | D3/202 |
| D773,809 | S * | 12/2016 | Lieser | D3/232 |
| 10,123,642 | B2 * | 11/2018 | Gazibara | A47G 23/0241 |
| D858,226 | S * | 9/2019 | Escontrela | D7/624.2 |
| D885,148 | S * | 5/2020 | Wang | D7/624.2 |
| D889,914 | S * | 7/2020 | Wadsworth | D3/229 |
| D889,915 | S * | 7/2020 | Wadsworth | D3/229 |
| D923,427 | S * | 6/2021 | Malinky | D7/624.2 |
| D925,995 | S * | 7/2021 | Wang | D3/229 |
| 11,172,752 | B2 * | 11/2021 | Dow | A47G 23/02 |
| D955,824 | S * | 6/2022 | Seiders | D7/607 |
| D966,041 | S * | 10/2022 | Tsukida | D7/624.2 |
| 11,492,175 | B2 * | 11/2022 | Wang | A45F 3/18 |
| 11,525,227 | B2 * | 12/2022 | Garland | A45F 3/02 |
| 2004/0020959 | A1 * | 2/2004 | Sellars | A45F 5/00 224/675 |
| 2010/0155437 | A1 * | 6/2010 | Broadbent | A45C 11/20 224/148.1 |
| 2015/0021346 | A1 * | 1/2015 | Cappuccio | A45F 5/00 220/735 |
| 2015/0265083 | A1 * | 9/2015 | Myers | A45F 5/10 220/737 |
| 2017/0009979 | A1 * | 1/2017 | Willows | A45F 5/00 |
| 2020/0085177 | A1 * | 3/2020 | Walk | A45C 3/001 |
| 2020/0237082 | A1 * | 7/2020 | Willows | A45F 5/00 |
| 2021/0130040 | A1 * | 5/2021 | Sanders | D04B 21/20 |
| 2021/0137248 | A1 * | 5/2021 | Dow | A47G 23/02 |
| 2021/0229865 | A1 * | 7/2021 | Wang | B65D 23/0871 |
| 2021/0244219 | A1 * | 8/2021 | Richard | B65D 81/3876 |

* cited by examiner

A-A

CONTAINER COVERING

CROSS-REFERENCE TO RELATED APPLICATIONS

Not Applicable.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

Technical Field

The present invention relates generally to covers for containers, such as water bottles. More particularly, the present invention relates to a sleeve with front and rear pouches for storing personal items.

Background

Container coverings are well known. They are particularly useful for insulating cans, cups, and bottles. Most such coverings comprise neoprene or elastic loops for gripping the container. Some such coverings have pockets providing minimal storage space for small personal items.

A need exists for a container covering that provides additional storage capacity. A need further exists for a container covering configured to retain an oversized smart phone. Still a further need exists for a container covering that provides a substantially enclosed storage cavity for storing small personal items, such as coins and jewelry. An additional need exists for a container covering comprising durable, substantially inelastic portions, connected by two smaller elastic portions.

SUMMARY OF THE INVENTION

A need exists for a sleeve for retaining a container, the sleeve comprising: a front element; a rear element; and a plurality of side elements. The front element comprises a substantially inelastic material forming a pouch. The front element further comprising a top edge and an exterior surface. The top edge of the front element defines a front aperture having an attached elastic collar.

The rear element comprises a substantially inelastic material that forms a closeable space. The rear element further comprises a zipper and an exterior surface. The zipper is configured to open and close the closeable space. The plurality of side elements comprises an elastic material, and the front element, the rear element, and the plurality of side elements are attached to form an axial aperture.

BRIEF DESCRIPTION OF THE DRAWINGS

The accompanying figures, which are incorporated in and constitute a part of the specification, illustrate various example systems, devices, methods, and so on, and are used merely to illustrate various example embodiments. Like reference numerals refer to identical or similar components or steps. It should be noted that the various components depicted in the figures may not be drawn to scale, and that the various assemblies and designs depicted in the figures are presented for purposes of illustration only, and should not be considered in any way as limiting.

DRAWING REFERENCE NUMERALS

Figure 1:
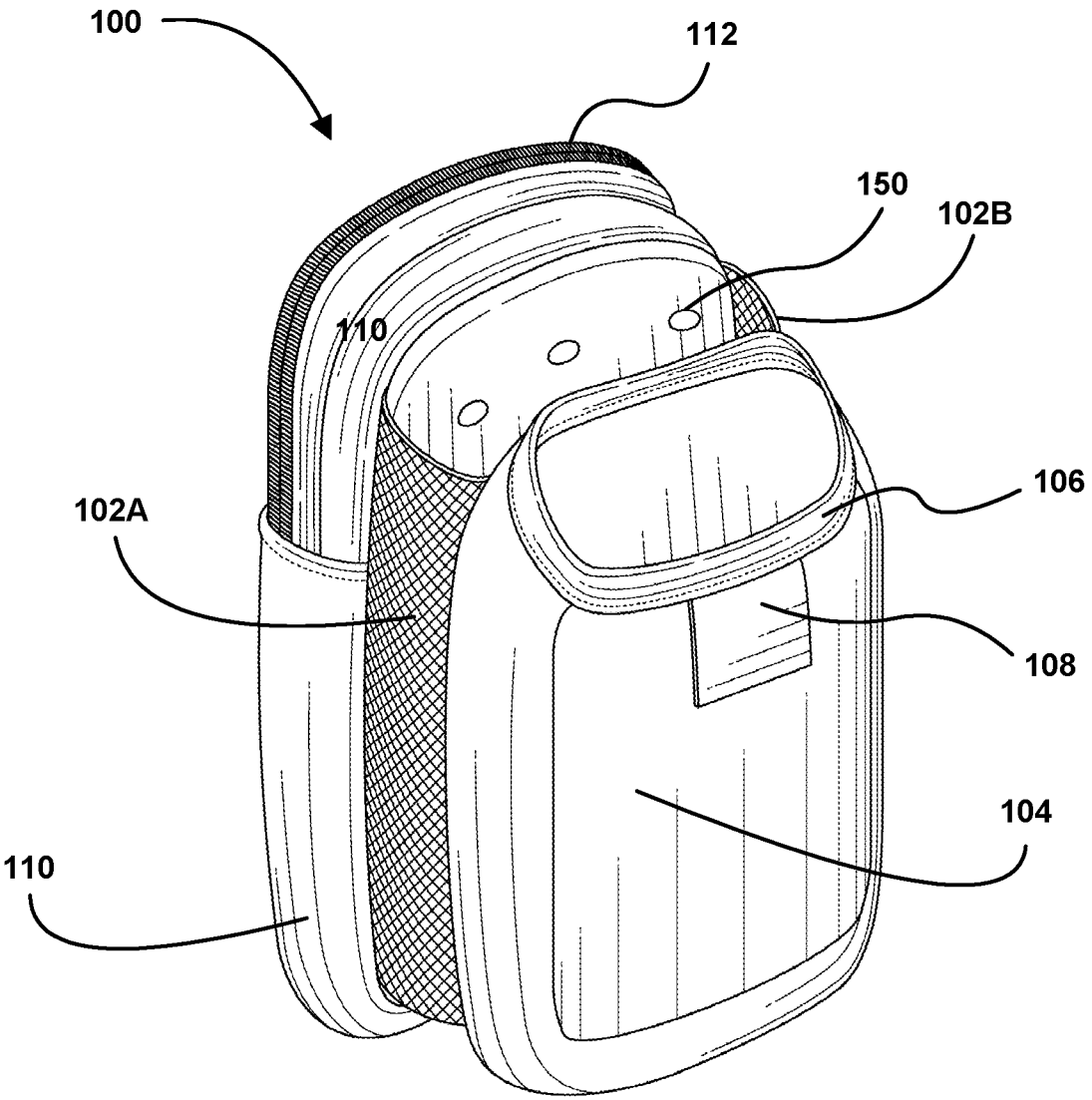
FIG. 1 is a 3D view of an example sleeve.
Figure 3:
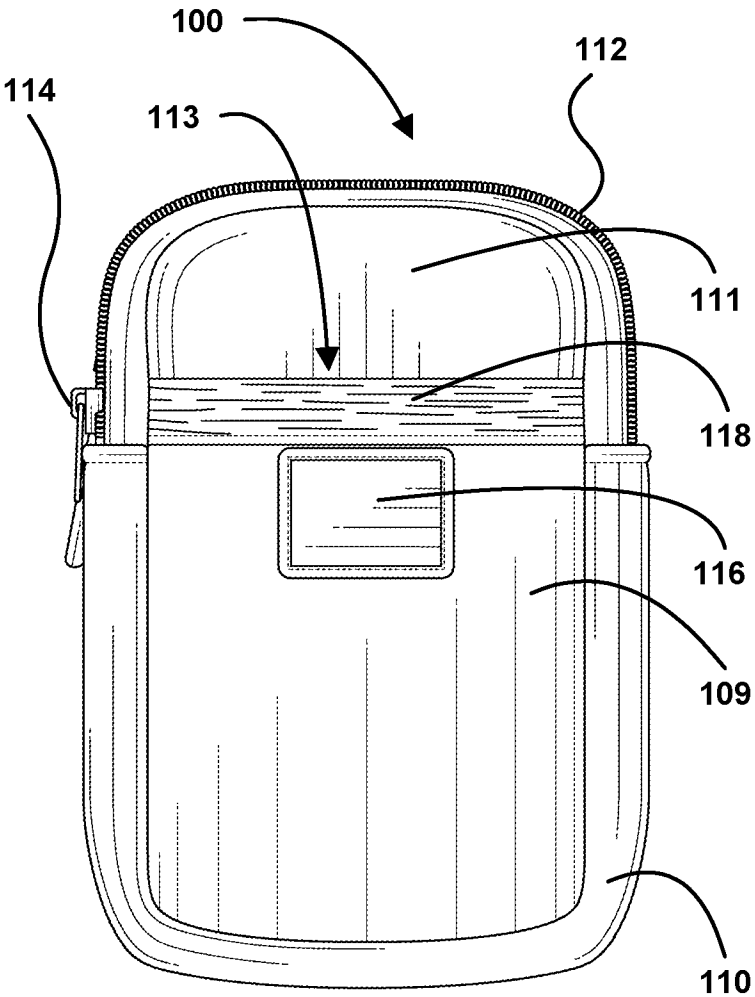
FIG. 3 is a rear side elevational view of the sleeve of FIG. 1.

The following reference characters identify the associated elements depicted in the drawings describing the present invention:

| Ref. | Element |
|---|---|
| 100 | Example Sleeve |
| 102A | Left Side Panel |
| 102B | Right Side Panel |
| 104 | Front Pouch |
| 106 | Collar |
| 108 | Tag |
| 109 | Pocket Fabric |
| 110 | Rear Pouch |
| 111 | Rear Pouch/Pocket Shared Layer |
| 112 | Zipper |
| 113 | Rear Pocket |
| 114 | Zipper Handle |
| 116 | Rear Tag |
| 118 | Rear Pocket Collar |
| 120 | Attachment Loop |
| 122 | Carabiner |
| 130 | Water Bottle |
| 140 | Axial Aperture |
| 150 | Grip Element |
| 158 | Interior Lining |
| 160 | Plurality of Interior Pockets |
| 162 | Pocket |
| 164 | Pocket |

DETAILED DESCRIPTION OF EMBODIMENTS OF THE INVENTION

Particular embodiments of exemplary sleeve devices will now be described in greater detail with reference to the figures. Like reference numerals apply to similar parts throughout the several views.

Figure 5A:
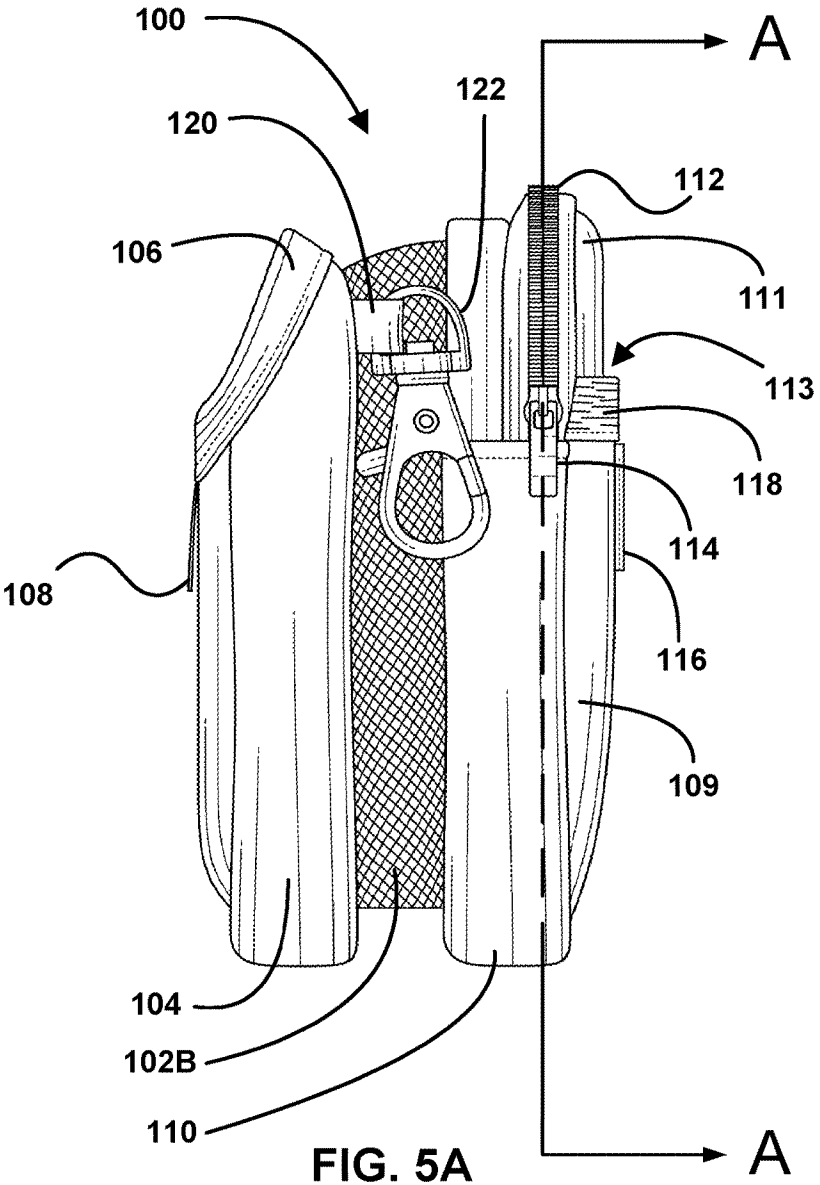
FIG. 5A is a right elevational view of the sleeve of FIG. 1.
Figure 4:
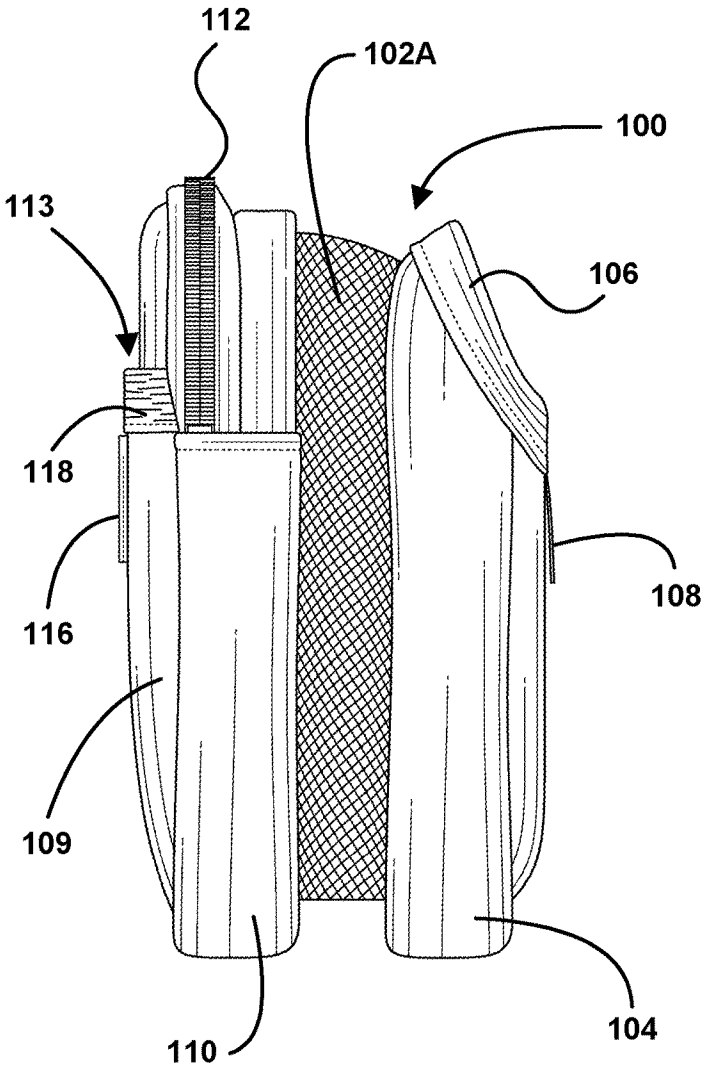
FIG. 4 is a left elevational view of the sleeve of FIG. 1.
Figure 5B:
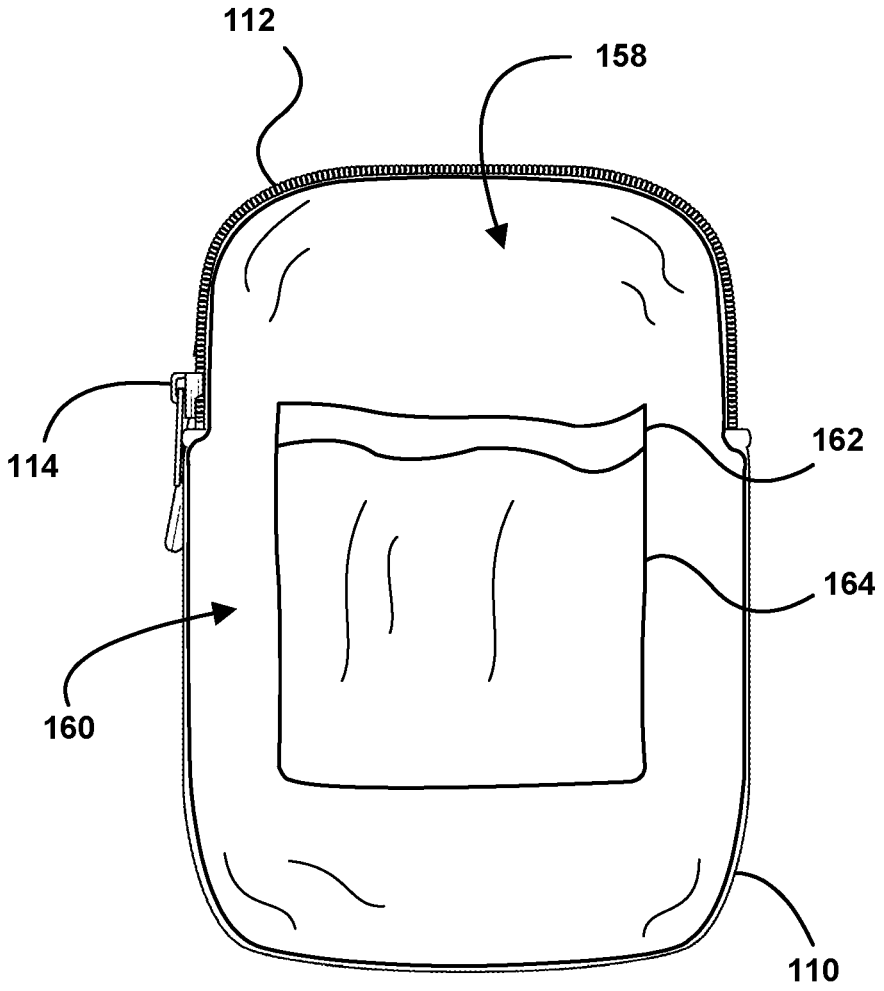
FIG. 5B is a cross-sectional view A-A of the sleeve of FIG. 1.
Figure 6:
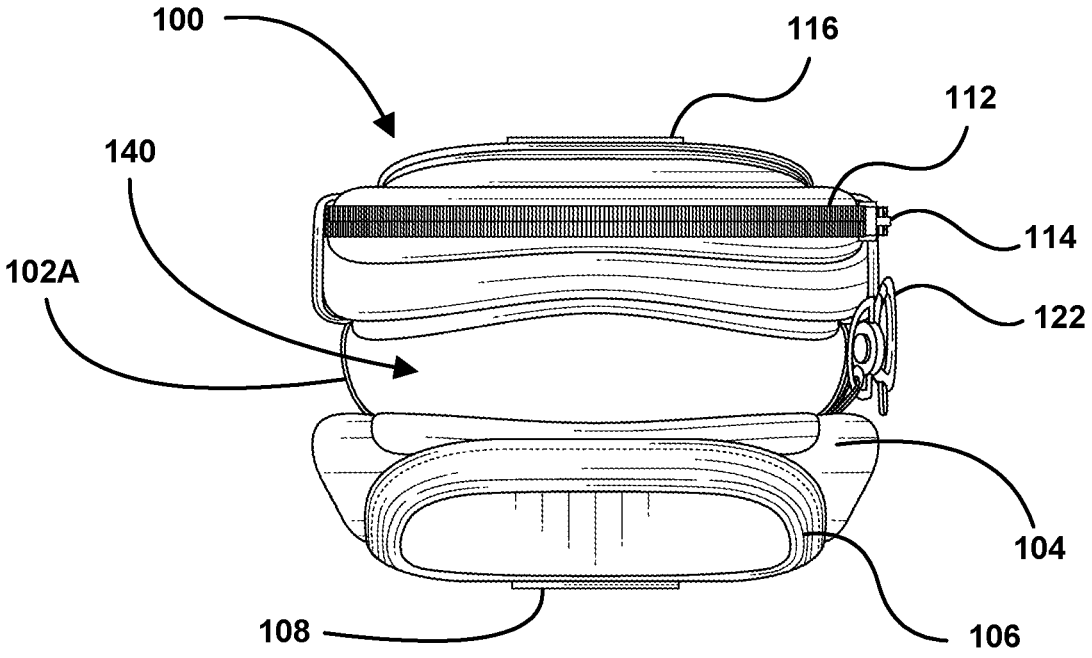
FIG. 6 is a top side elevational view of the sleeve of FIG. 1.
Figure 7:
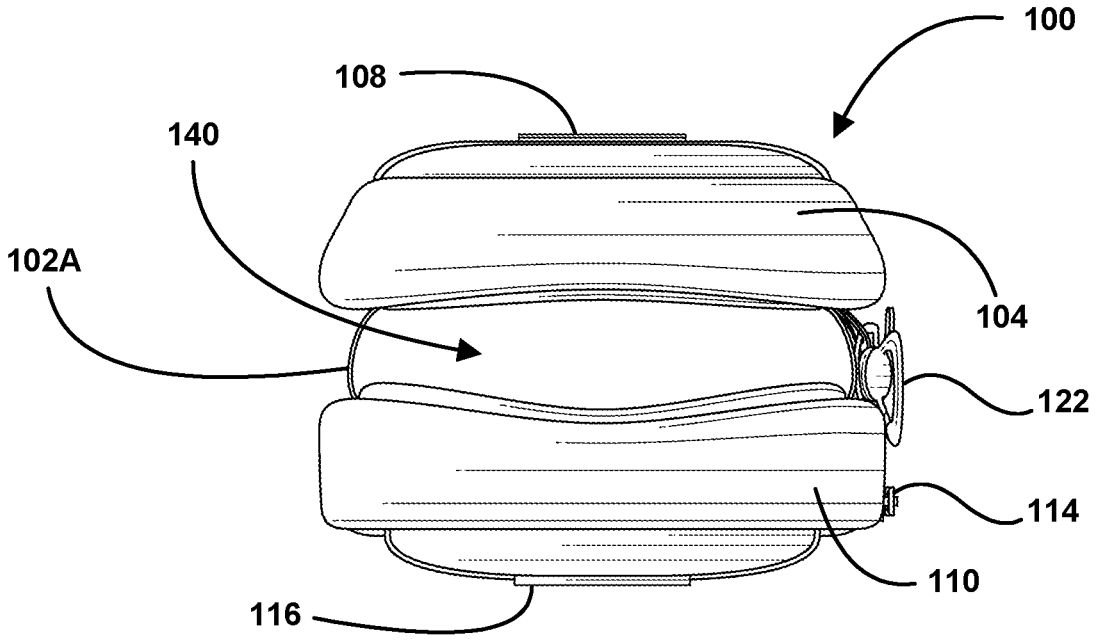
FIG. 7 is a bottom side elevational view of the sleeve of FIG. 1.
Figure 8:
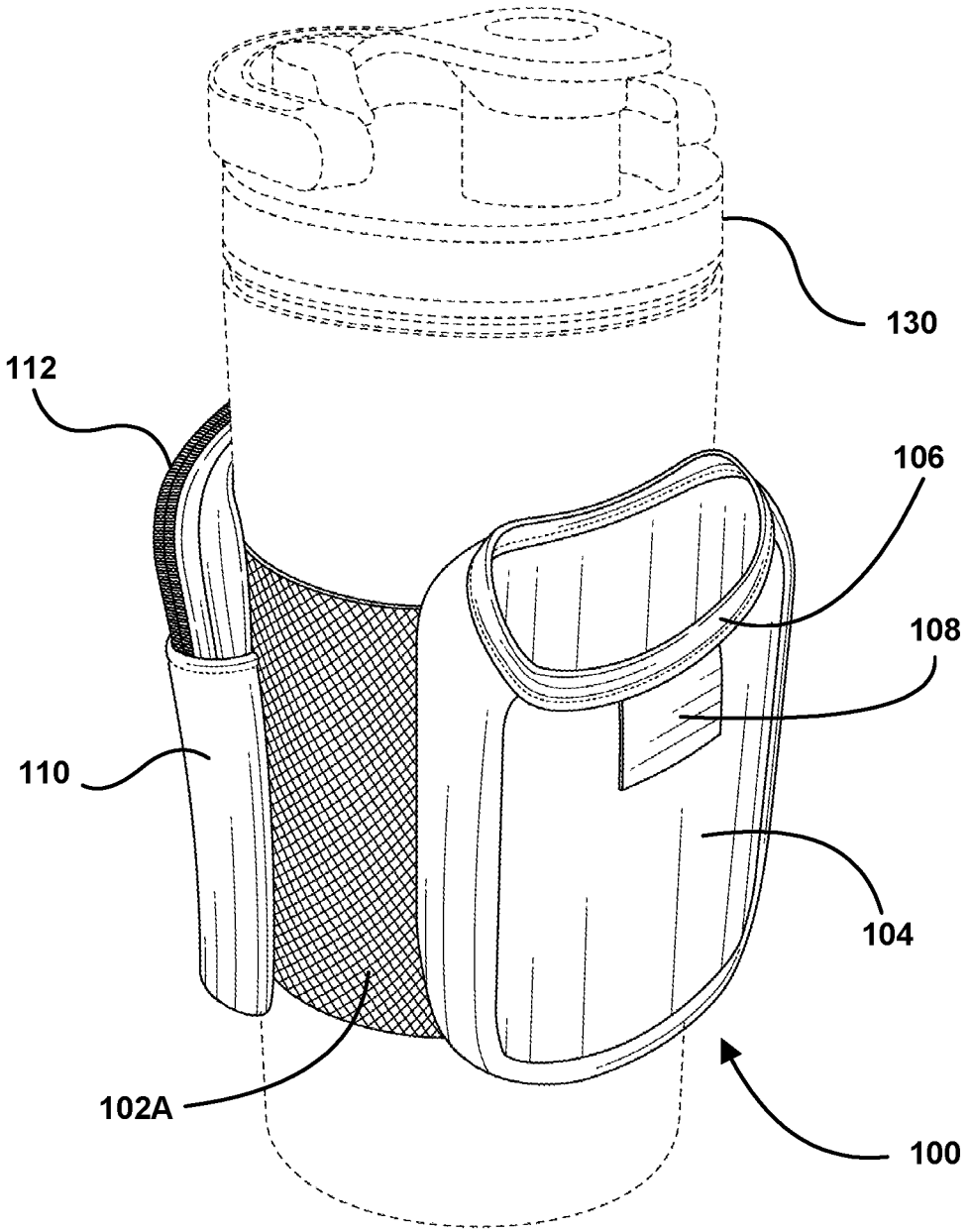
FIG. 8 is a 3D environmental view of a sleeve.
Figure 10:
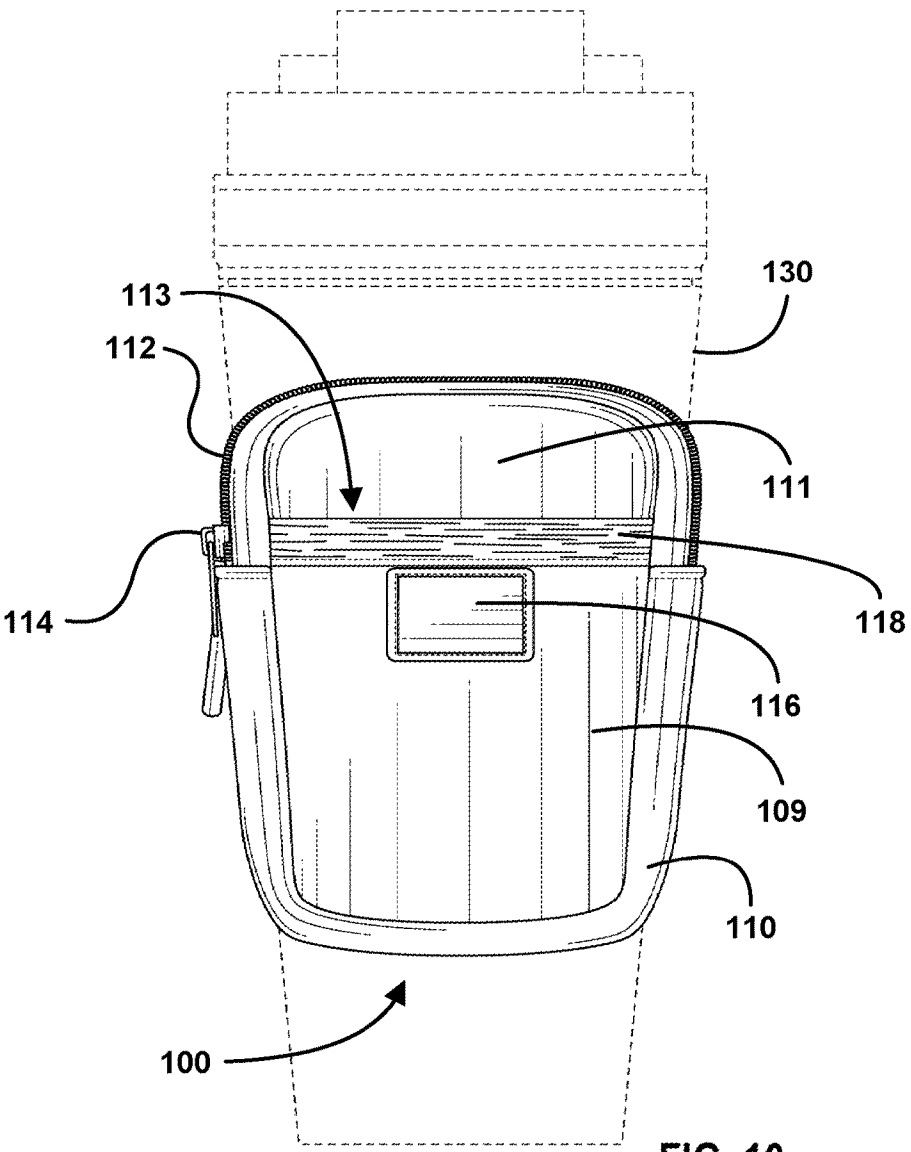
FIG. 10 is a rear side elevational view of the sleeve of FIG. 8.
Figure 9:
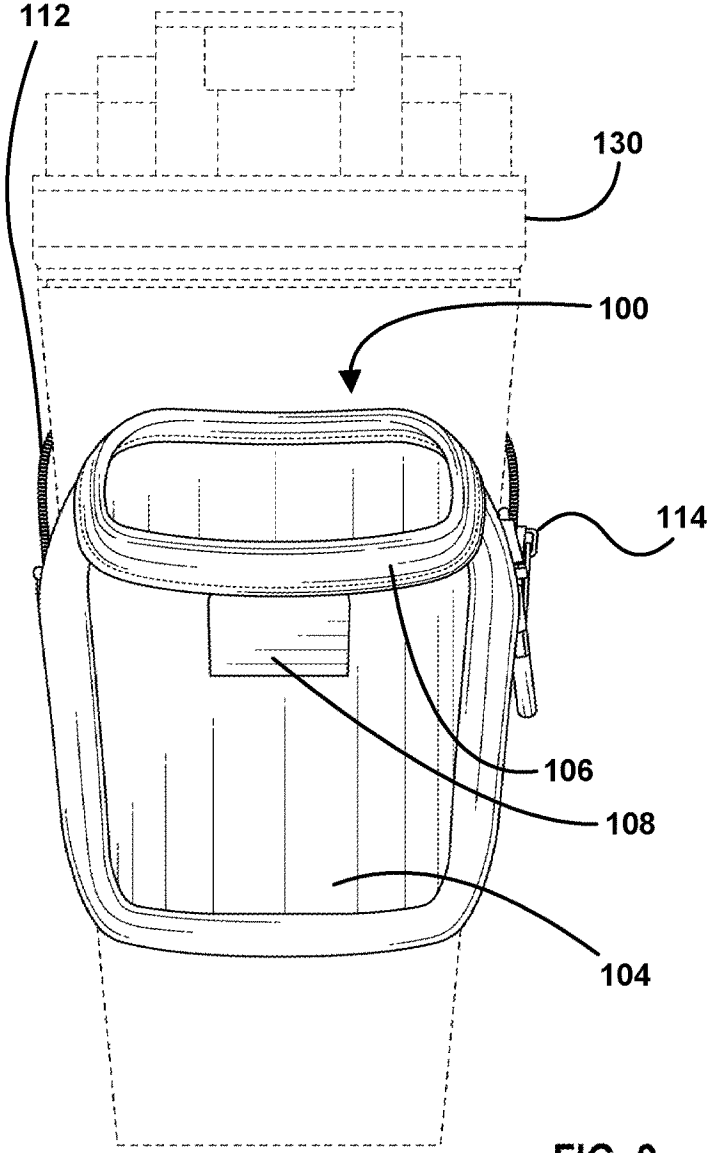
FIG. 9 is a front side elevational view of the sleeve of FIG. 8.
Figure 12:
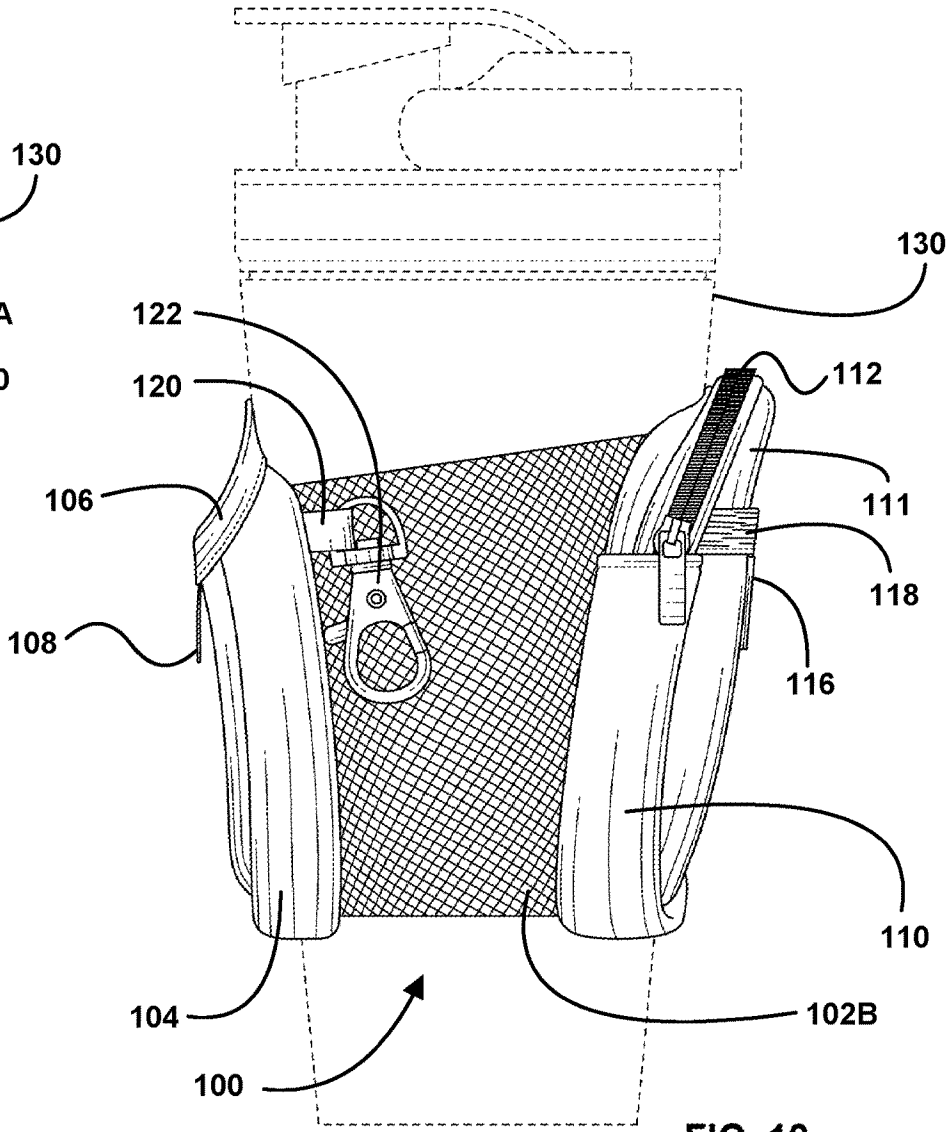
FIG. 12 is a right elevational view of the sleeve of FIG. 8.
Figure 11:
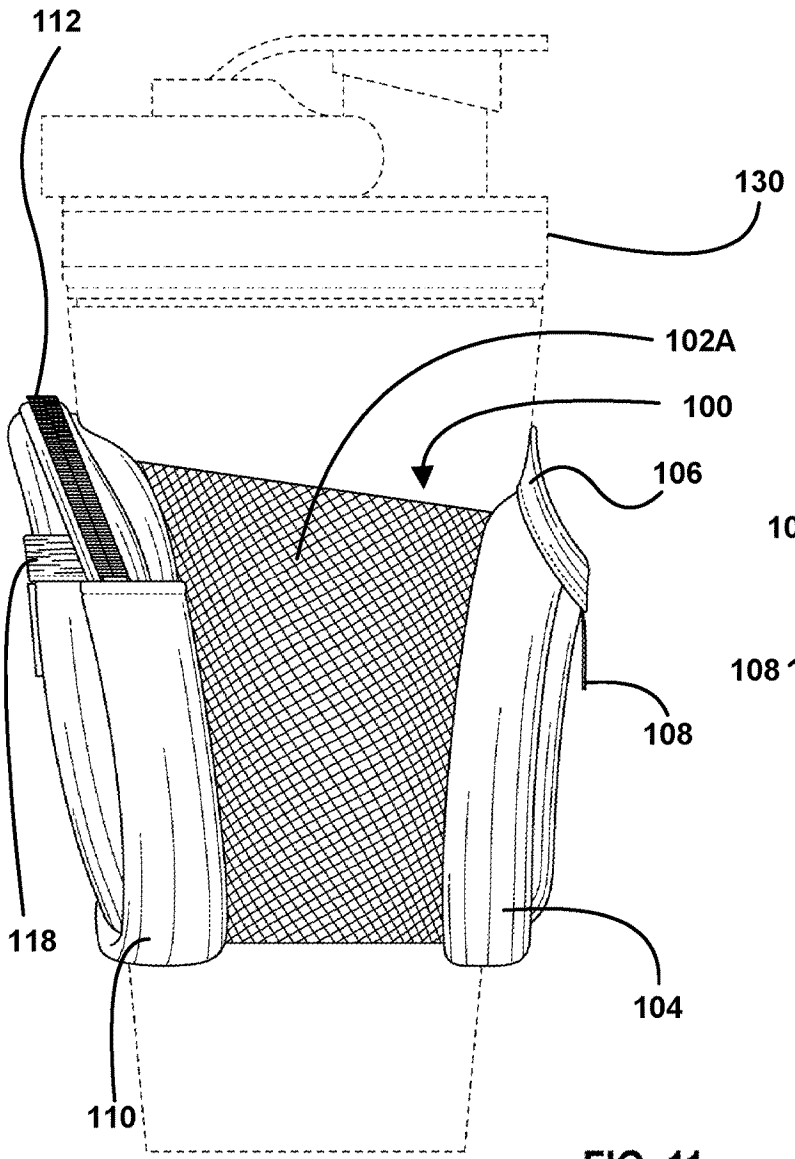
FIG. 11 is a left elevational view of the sleeve of FIG. 8.
Figure 13:
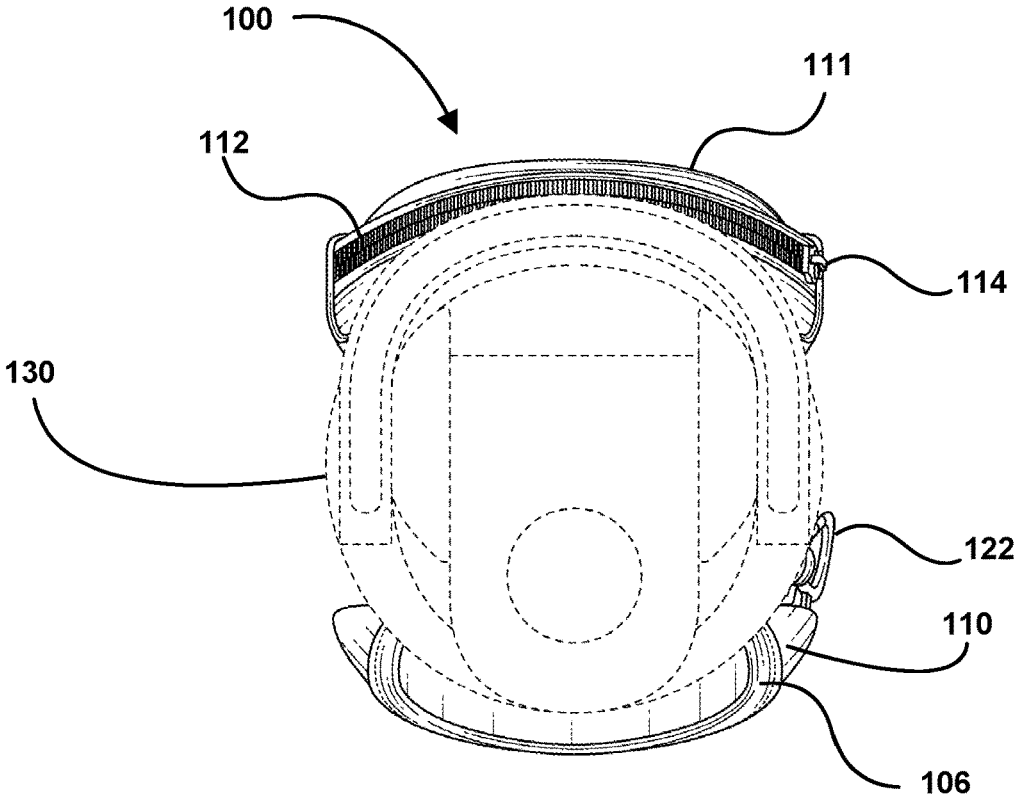
FIG. 13 is a top side elevational view of the sleeve of FIG. 8.
Figure 14:
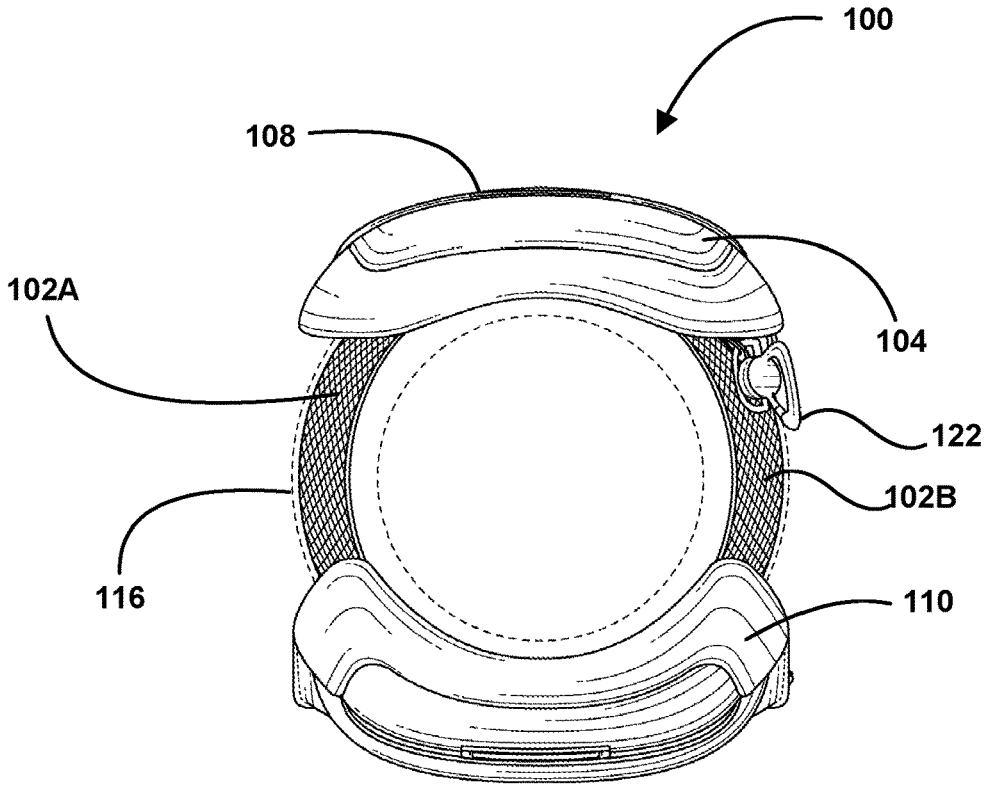
FIG. 14 is a bottom side elevational view of the sleeve of FIG. 8.

FIGS. 1-7 depict various views of an example sleeve 100. As best illustrated in FIGS. 1, 6, and 7, sleeve 100 comprises a front pouch 104, a rear pouch 110, a left side panel 102A, and a right side panel 102B. As best illustrated in FIGS., front pouch 104, rear pouch 110, left side panel 102A, and right side panel 102B are connected such that they form a generally axial aperture 140 through which a container may be inserted. FIGS. 8-14 depict various environmental views of the example sleeve 100 water bottle 130 inserted through axial aperture 140.

With reference to FIG. 1, in one alternate embodiment, the interior surface of the axial aperture 140 may comprise a plurality of grip elements, such as grip element 109. Grip element 109 is attached to the interior surface so as to prevent or reduce the chance that the container will slip out of sleeve 100. Although FIG. 1 illustrates attached grip elements 109, in an alternate embodiment, the interior surface itself may form a plurality of integrated grip elements. Grip elements may also be attached or integrated with any portion of the surface of axial aperture 140, including left side panel 102A, right side panel 102B, front pouch 104 and rear pouch 110.

Figure 2:
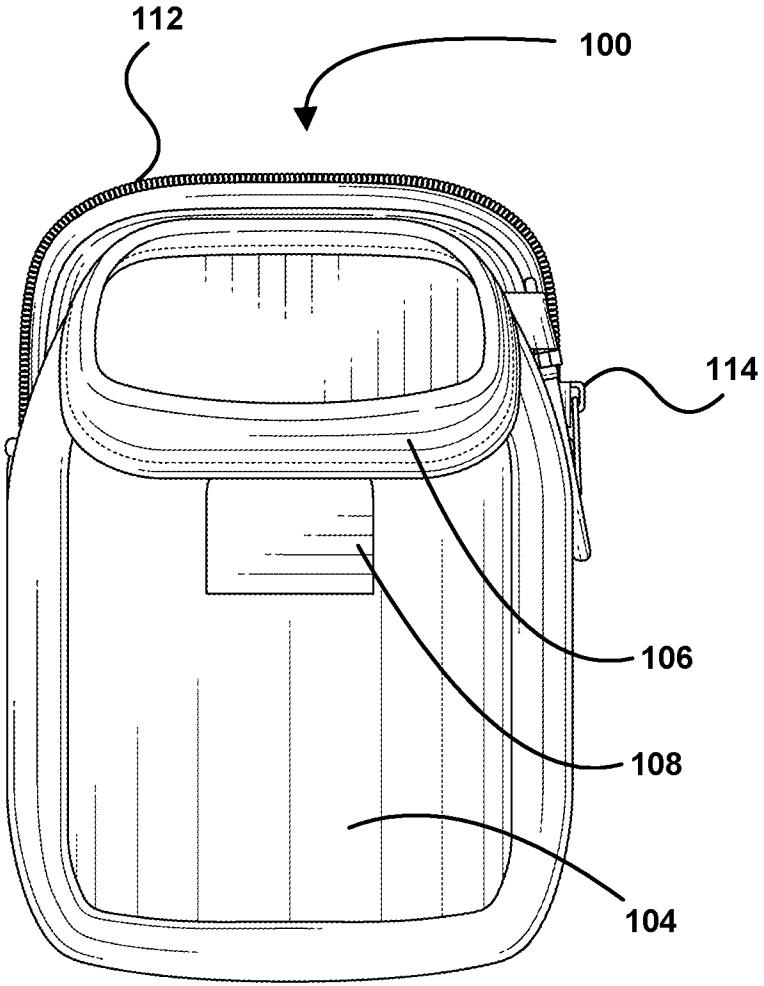
FIG. 2 is a front side elevational view of the sleeve of FIG. 1.

Front pouch is best illustrated by FIGS. 1 and 2. In one example embodiment, front pouch 104 is made of generally inelastic material or fabric such as canvas. Front pouch 104 comprises a collar 106. In the illustrated embodiment, collar 106 comprises a generally elastic material attached to a top edge of front pouch 104. A front tag 108 may also attached to front pouch 104, for example, in proximity to collar 106 to provide a convenient portion for the user to grip in order to stretch collar 106. Of course, tag 106 may also contain indicia for identifying or decorating sleeve 100.

Rear pouch 110 is best illustrated by FIGS. 3-7. Like front pouch 106, rear pouch 110 may also be constructed from generally inelastic material. Rear pouch 110 comprises a closure mechanism configured to open and close rear pouch 110. In the example embodiment, the closure mechanism is a zipper 112 which may be opened and closed by a user by moving zipper handle 114. Rear pouch 110 may further comprise a rear pocket 113. Rear pouch 110 comprises a rear surface 111, and rear pocket 113 is formed rear surface 111 and an attached layer of fabric 109. Fabric 109 may be elastic or inelastic, depending on the anticipated use of pocket 109, and fabric 109 may comprise an elastic rear collar 118 to keep pocket 113 closed.

As illustrated in FIGS. 1-7, front pouch 104 and rear pouch 110 are connected on either side by left side panel 102A and right side panel 102B. Left and right side panels 102A and 102B may be constructed from generally elastic material so as to allow sleeve 100 to conform to the contour of any of a variety of containers.

As illustrated in FIGS. 5A-7, sleeve 100 may comprise one or more attachment points and/or attachment mechanisms. In the illustrated embodiment, sleeve 100 comprises attachment loop 120 which is configured to receive carabiner 122. Attachment loop 120 and carabiner 122 are useful for connecting articles such as keys and/or key fobs, for example, to sleeve 100. They are also useful for attaching sleeve 100 to other items, such as exercise equipment and/or beach chairs, for example.

FIG. 5B is a view of cross-section A-A shown in FIG. 5A. As illustrated in FIGS. 5A and 5B, rear pouch 110 may comprise an interior lining 158 and a plurality of pockets 160. Example pockets 162 and 164 may be sewn into the interior lining 158 to permit a user to store credit cards, keys, loose change, and similar small items. Although the plurality of pockets 160 are illustrated inside the pouch in the direction of cross-section A-A, in alternate embodiments, one or more pockets could be located in the opposite wall of pouch 110 in addition to or in lieu of the plurality of pockets 160.

While the devices, methods, and so on have been illustrated by describing examples, and while the examples have been described in considerable detail, it is not the intention of the applicant to restrict, or in any way, limit the scope of the appended claims to such detail. It is, of course, not possible to describe every conceivable combination of components or methodologies for purposes of describing the systems, methods, and so on provided herein. Additional advantages and modifications will readily appear to those skilled in the art. Therefore, the invention, in its broader aspects, is not limited to the specific details and illustrative examples shown and described. Accordingly, departures may be made from such details without departing from the spirit or scope of the applicant's general inventive concept. Thus, this application is intended to embrace alterations, modifications, and variations that fall within the scope of the appended claims. The preceding description is not meant to limit the scope of the invention. Rather, the scope of the invention is to be determined by the appended claims and their equivalents.

Finally, to the extent that the term "includes" or "including" is employed in the detailed description or the claims, it is intended to be inclusive in a manner similar to the term "comprising," as that term is interpreted when employed as a transitional word in a claim. Furthermore, to the extent that the term "or" is employed in the claims (e.g., A or B) it is intended to mean "A or B or both." When the applicants intend to indicate "only A or B, but not both," then the term "only A or B but not both" will be employed. Similarly, when the applicants intend to indicate "one and only one" of A, B, or C, the applicants will employ the phrase "one and only one." Thus, use of the term "or" herein is the inclusive, and not the exclusive use. See Bryan A. Garner, A Dictionary of Modern Legal Usage 624 (2d. Ed. 1995).

What is claimed is:

1. A sleeve for retaining a container, the sleeve comprising:

a front element, the front element comprising a substantially inelastic material forming a pouch, the front element further comprising a top edge and an exterior surface, the top edge being a closed loop and defining a front aperture, the top edge disposed such that a front portion of the top edge is lower than a rear portion of the top edge, the front element further comprising an elastic collar attached to the top edge;

a rear element, the rear element comprising a substantially inelastic material forming a closeable space, the rear element further comprising a zipper and an exterior surface, the zipper configured to open and close the closeable space;

a plurality of individual side elements comprising an elastic material; and whereby the front element, the rear element, and the plurality of individual side elements are attached to form an axial aperture.

2. The sleeve of claim 1 wherein the rear element further comprising a rear pocket.

3. The sleeve of claim 1 wherein the front element further comprising a front tag.

4. The sleeve of claim 3 wherein the front tag is affixed to the exterior surface of the front element below the collar.

5. The sleeve of claim 1 wherein the rear element further comprising a rear tag.

6. The sleeve of claim 5 wherein the rear tag is affixed to the exterior surface of the rear element.

7. The sleeve of claim 6 wherein the rear tag is affixed so that it is flush to the exterior surface of the rear element.

8. The sleeve of claim 1 wherein:

the axial aperture comprises an interior surface configured to cooperate with a container; and the interior surface comprises a plurality of grip elements arranged in one or more rows.

9. The sleeve of claim 8 wherein the plurality of grip elements are attached to the interior surface.

10. The sleeve of claim 8 further comprising a plurality of interior pockets disposed within the closeable space of the rear element.

* * * * *